United States Patent [19]

Ettehadieh

[11] Patent Number: 4,889,060

[45] Date of Patent: Dec. 26, 1989

[54] WEB FOR ROTARY COMBUSTOR

[75] Inventor: Bozorg Ettehadieh, Wilkins Township, Allegheny County, Pa.

[73] Assignee: Westinghouse Electric Corp., Pittsburgh, Pa.

[21] Appl. No.: 302,491

[22] Filed: Jan. 27, 1989

[51] Int. Cl.[4] ..... A47J 36/00; A47J 36/24

[52] U.S. Cl. ..... 110/246; 110/226; 432/116

[58] Field of Search ..... 110/246, 226; 432/116

[56] References Cited

U.S. PATENT DOCUMENTS

| | | | |
|---|---|---|---|
| 3,703,277 | 11/1972 | Bosshard | 432/116 |
| 3,808,988 | 5/1974 | Sugano et al. | 110/246 |
| 3,916,807 | 11/1975 | Eiki | 110/246 |
| 4,226,584 | 10/1980 | Ishikawa | 110/246 |
| 4,724,778 | 2/1988 | Healy | 110/246 |
| 4,735,156 | 4/1988 | Johnson et al. | 110/246 |

FOREIGN PATENT DOCUMENTS

| | | | |
|---|---|---|---|
| 1141562 | 1/1969 | United Kingdom | 110/246 |

*Primary Examiner*—Edward G. Favors
*Assistant Examiner*—Denise L. Ferensic
*Attorney, Agent, or Firm*—Fred J. Baehr, Jr.

[57] ABSTRACT

An inclined combustion barrel for a rotary combustor utilized to burn municipal solid waste wherein the combustion barrel is formed from a plurality of parallel cooling pipes disposed in a circular array with a plurality of spaced apart flat plates disposed between adjacent cooling pipes in descending order with overlapping ends and side margins welded to the cooling pipes to form a web between the cooling pipes which provide influent air flow and extends the life of the web.

8 Claims, 2 Drawing Sheets

WEB FOR ROTARY COMBUSTOR

BACKGROUND OF THE INVENTION

The invention relates to a rotary combustor for burning municipal solid waste and more particularly to an improvement in the web between cooling pipes forming the combustor.

Webs disposed between cooling pipes of rotary combustors burning municipal solid waste are subjected to severe operating conditions, high operating temperatures, erosive and corrosive elements in the municipal waste and a gas environment which switches back and forth between being oxidizing and reducing atmospheres resulting in thinning or wasting of the webs. Making the webs thicker only delays replacement and reducing the space between cooling pipes to improve heat transfer causes other problems in the combustion of the waste.

U.S. Pat. No. 4,724,778 describes a rotary combustor in which municipal solid waste is burned in a gas porous cylinder, having a sectioned and compartmented wind box permitting selective delivery of air through the burning waste, above the burning waste, at the start of the burning process and after burning has been well initiated. However the gas porous webs which connect the cooling pipes to form the rotary combustor experience metal wastage and thinning resulting in increased maintenance cost and plant availability losses.

SUMMARY OF THE INVENTION

Among the objects of the invention may be noted the provision of web members, which will provide more efficient heat dissipation, improve the influent combustion air flow and stand up to the environment of burning municipal solid waste.

In general, a rotary combustor, when made in accordance with this invention, comprises a plurality of spaced apart, parallel cooling pipes disposed in a circular array to form a generally cylindrical combustor barrel. The barrel is disposed for rotation on an inclined axis so that the inlet end of the barrel is above the outlet end and a plurality of generally flat plates are disposed between adjacent cooling pipes to form the barrel. The plates are disposed generally to each other in descending order from the inlet to the outlet end of the combustor barrel with side margins of the plates welded to the pipes, with end margins overlapping a distance L and with a space D extending between adjacent plates to allow combustion air to flow therethrough. The plates are so disposed that the ratio of L/D is greater than 1 and preferably in the range of 4 to improve influent air flow and the life of the plates. The angular disposition of the plates is also varied to provide the optimum influent air flow to each portion of the rotary combustor.

BRIEF DESCRIPTION OF THE DRAWINGS

The invention as set forth in the claims will become more apparent by reading the followng detailed description in conjunction with the accompanying drawings, wherein like reference numerals refer to like parts throughout the drawings and in which:

DESCRIPTION OF THE PREFERRED EMBODIMENT

Figure 1:
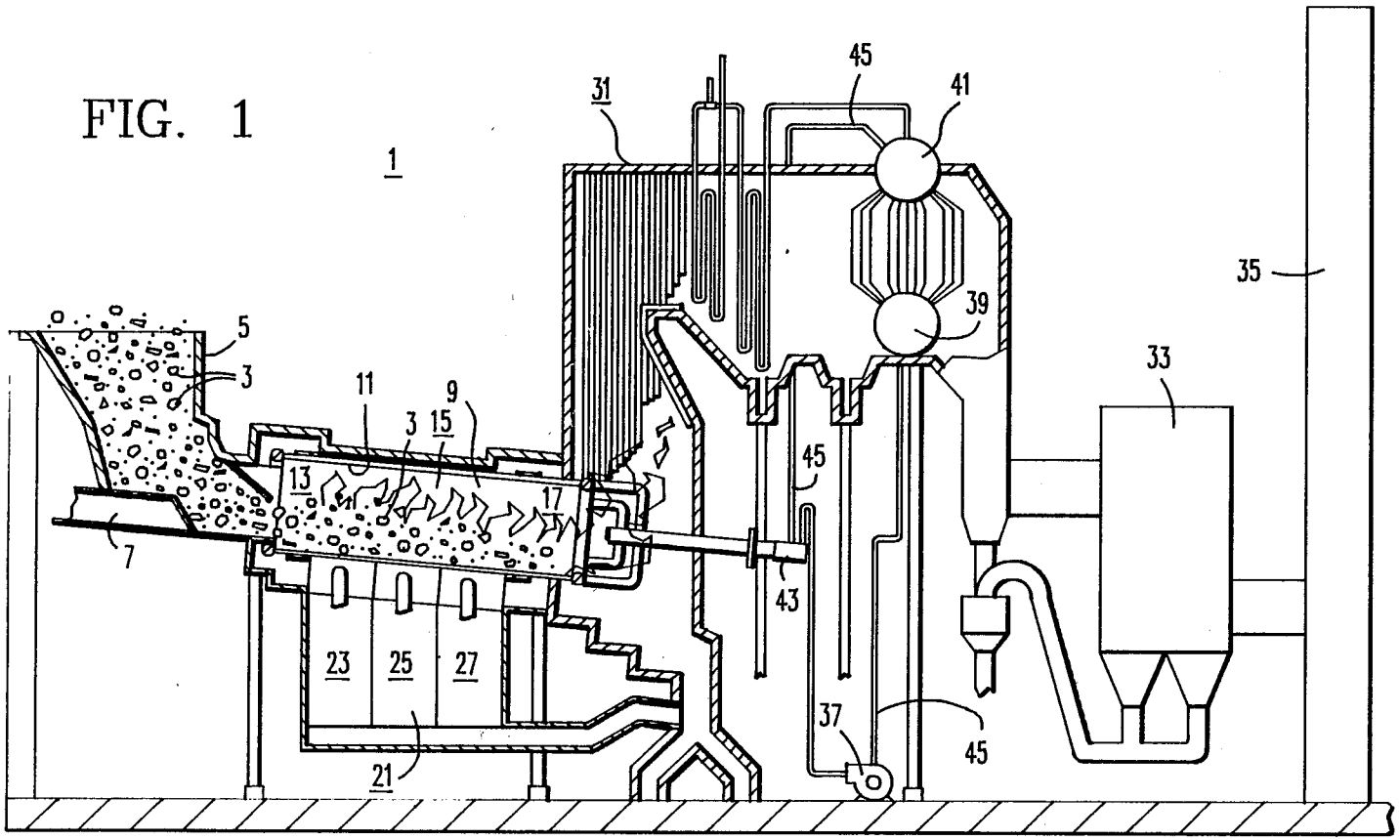
FIG. 1 is a schematic view of an incinerator having a rotary combustor made in accordance with this invention.

Referring now to the drawings in detail and in particular to FIG. 1 there is shown an incinerator 1 for burning municipal solid waste 3, which is fed through a hopper 5 to a ram 7. The ram 7 pushes discrete amounts of the waste 3 into a rotary combustor or combustion barrel 9, wherein the waste 3 is burned. The combustion barrel 9 is formed from a plurality of generally parallel cooling pipes 11 disposed in a circular array to form a generally cylindrical barrel 9. The cylindrical combustion barrel 9 is divided into an inlet or drying portion 13 adjacent the hopper 5, an intermediate or combustion portion 15 and an outlet or burn out portion 17. The combustion barrel 9 is disposed for rotation on an inclined axis 19 forming an angle C with a horizontal line so that an inlet end 13 thereof is disposed above an outlet end 17 thereof. A wind box 21 is disposed to supply combustion air to the combustion barrel 9. The wind box 21 is divided in to an inlet portion 23, from which the air is suplied to an inlet or drying portion 13 of the combustor barrel 9, to dry the waste 3; an intermediate portion 25, from which combustion air is supplied to the combustion portion 15 of the combustor barrel 9, to devolatilize and burn the waste 3; and an outlet portion 26, from which combustion air is supplied to the burnout portion 17 of the combustion barrel 9, to burn the combustible solids and to burn CO and any other combustible gases. Each portion of the wind box 21 is further divided into underfire and overfire portions, each portion having separate controls so that the underfire air and overfire air can be separately controlled in each portion of the combustion barrel 9.

Exhaust gases from the rotary combustor barrel 9 flow through a waste heat boiler 31, a filter 33 such as an electrostatic precipitator or other filtering means and to a stack 35 from which they are exhausted to the atmosphere.

The cooling pipes 11 making up the rotary combustion barrel 9 are supplied with cooling fluid from a circulating pump 37, which takes it suction from a water drum 39 in the waste heat boiler 31 and returns the heated cooling fluid to a steam drum 41 deposited at the top of the waste heat boiler 31 via a rotary joint 43 and associated piping 45.

Figure 2:
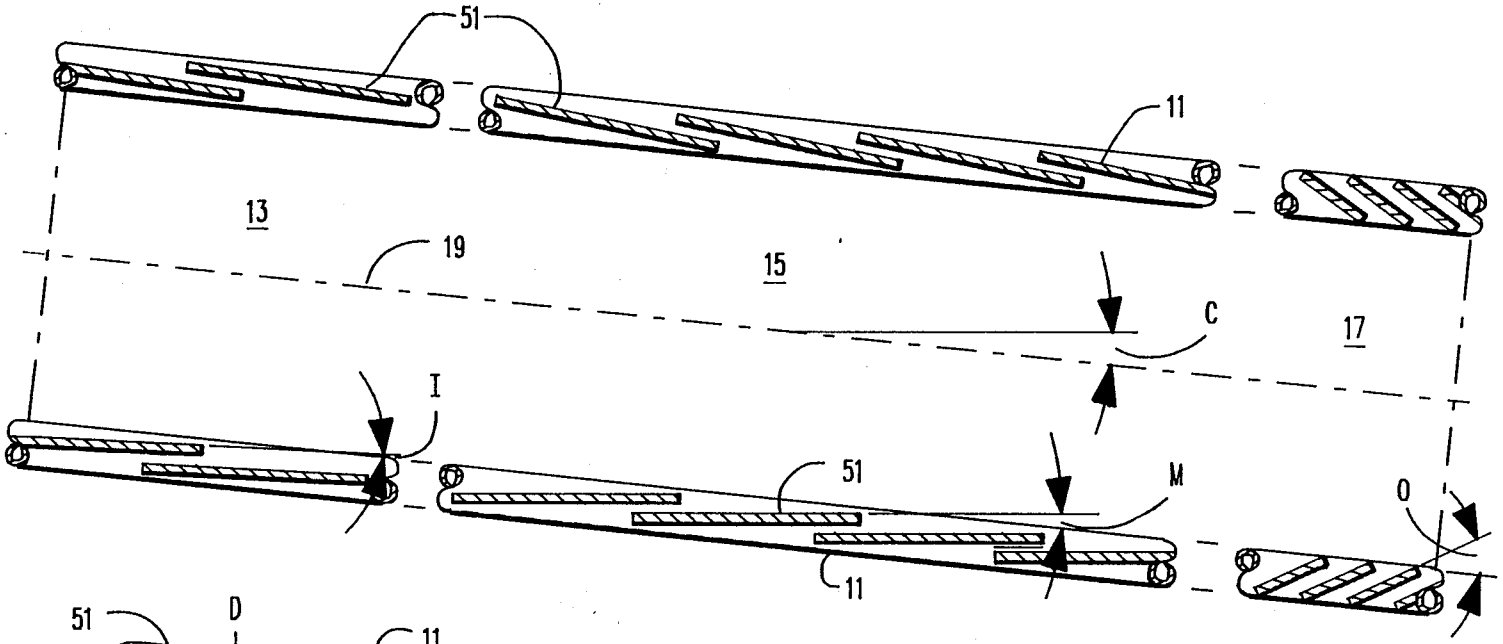
FIG. 2 is a partial sectional view of the rotary combustor.
Figure 3:
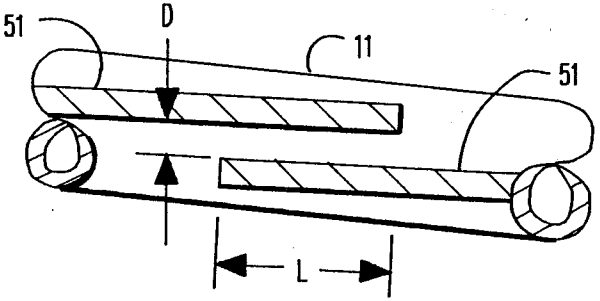
FIG. 3 is an enlarged partial sectional view of a portion of the rotary combustor.

As shown in FIG. 2 and 3 the cooling pipes 11 are spaced apart and a plurality of generally flat plates 51 are disposed between adjacent cooling pipe 11 to form a web. The plates 51 are disposed generally parallel to each other in descending order from the inlet end of the combustion barrel 9 to the outlet end thereof. Side margins of the plates 51 are welded to the cooling pipes 11 and end margins of the plates 51 overlay a distance L with a space D extending between adjacent plates 51. The spacing and location of the plates 51 with respect to one another may vary from one end of the rotary combustor 9 to the other, however, in order to provide good penetration of the combustion air into the waste 3 and combustor 9 the ratio of L/D should be greater than 1 and preferably in the general range of 4. The axis 19 of the rotary combustor 9 is tilted downwardly forming an angle C with a horizontal line, which angle is generally 6°. As indicated in FIG. 2 the plates 51 are disposed at various angles I, M and O with respect to the cooling pipes 11. The angle I is generally less than 6°, while the angle M is generally 6°, positioning the plates in the burning portion of the combustor barrel 9 generally horizontally. The plates 51 in the burnout portion 17 of the combustor barrel 9 form an angle O which is more than 6°, in order to provide better penetration of combustion air into this zone and the quantity of overfire air supplied to this zone is preferably more than the quantity of underfire air supplied to this zone to minimize the quantity of CO in the exhaust gases. While the angles shown are preferred for a particular zone it is understood that multiple angles may be utilized in a single zone and that anlges other than those shown could be used in the zones. One advantage of providing angles less than 6° is that smaller angles will position the plates 51 so that when disposed in the incinerator 1 they will slope downwardly and prevent melted aluminum from entering the wind box 21.

The disposition of the flat plates 51 between the cooling pipes 11 as set forth herein advantageously improves the heat transfer to the plates by providing more efficient convective cooling of the plates 51 as influent air is forced to flow over the upper and lower surfaces. This arrangement also positions a portion of the plates 51 so that portions of the plates 51 are not in contact with the burning waste to provide better heat transfer from the portions that are in contact with the burning waste as more heat will be conducted to both the influent combustion air and to the cooling pipes 11. The boundary layer of influent combustion air flowing over both sides of the plates 51 will maintain an oxidizing atmosphere encompassing the plates 51 eliminating the alternating exposure to reducing and oxidizing conditions, thus reducing the erosion and wastage of the plates 51 and improving the distribution of influent underfire combustion air to the combustion portion 15 of the rotary combustor 9 as the combustion air enters the combustor barrel 9 close to horizontally so as not to have to partially support the fuel bed as is required with holes punched in the web. Also the individual plates 51 can be removed and changed without disturbing neighboring plates 51 improving the maintenance and replacement thereof.

While the preferred embodiments described herein set forth the best mode to practice this invention presently contemplated by the inventor, numerous modifications and adaptations of this invention will be apparent to others skilled in the art. Therefore, the embodiments are to be considered as illustrative and exemplary and it is understood that numerous modifications and adaptations of the invention as described in the claims will be apparent to those skilled in the art. Thus, the claims are intended to cover such modifications and adaptations as they are considered to be within the spirit and scope of this invention.

What is claimed is:

1. A rotary combustor utilized to burn municipal solid waste comprising a plurality of spaced apart, parallel cooling pipes disposed in a circular array to form a generally cylindrical combustor barrel, said barrel being disposed for rotation on an inclined axis so that the inlet end of the barrel is above the outlet end and a plurality of generally flat plates being disposed between contiguous cooling pipes, the plates being disposed generally parallel to each other in descending order from the inlet to the outlet end of the combustor barrel with side margins of the plates welded to the pipes, with end margins overlapping a distance L and with a space D extending between adjacent plates to allow combustion air to flow therethrough.

2. The rotary combustor of claim 1, wherein the ratio of L over D is greater than 1.

3. The rotary combustor of claim 1, wherein the ratio of L over D is preferably 4.

4. The rotary combustor of claim 1, wherein the plates are disposed at an angle with respect to the axis of the contiguous pipes and said angle is generally in the range of the angle that the rotary combustor is inclined.

5. The rotary combustor of claim 1, wherein the plates are disposed at an angle with respect to the axis of the contiguous pipes, the angle of the plates varying in different portions of the combustion barrel.

6. The rotary combustor of claim 1, wherein the plates in at least one portion of the combustor are disposed at an angle with respect to the axis of the contiguous pipes and said angle is slightly less than the angle at which the rotary combustor is inclined.

7. The rotary combustor of claim 1, wherein the plates in at least a portion of the plates adjacent the outlet end of the combustion barrel are disposed at an angle with respect to the axis of the contiguous pipes and said angle is greater than the angle at which the rotary combustor is inclined.

8. The rotary combustor of claim 1, wherein the axis of rotation of the combustor is inclined about 6° and the plates are disposed at an angle with respect to the contiguous pipes preferably 6°.

* * * * *